US008172044B2

(12) United States Patent
Tokura

(10) Patent No.: US 8,172,044 B2
(45) Date of Patent: May 8, 2012

(54) ELEVATOR SYSTEM

(75) Inventor: Sakurako Tokura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 427 days.

(21) Appl. No.: 12/524,863

(22) PCT Filed: Mar. 26, 2007

(86) PCT No.: PCT/JP2007/056203

§ 371 (c)(1),
(2), (4) Date: Jul. 29, 2009

(87) PCT Pub. No.: WO2008/117394

PCT Pub. Date: Oct. 2, 2008

(65) Prior Publication Data

US 2011/0048866 A1 Mar. 3, 2011

(51) Int. Cl.
*B66B 1/18* (2006.01)

(52) U.S. Cl. ..... 187/387; 187/391

(58) Field of Classification Search ..... 187/247, 187/380–389, 391–396

See application file for complete search history.

(56) References Cited

U.S. PATENT DOCUMENTS

| | | | | |
|---|---|---|---|---|
| 5,058,711 | A * | 10/1991 | Tsuji | 187/383 |
| 5,260,526 | A * | 11/1993 | Sirag, Jr. | 187/387 |
| 5,274,202 | A * | 12/1993 | Kezer et al. | 187/385 |
| 5,511,635 | A * | 4/1996 | Kameli | 187/392 |
| 5,808,247 | A * | 9/1998 | Thangavelu | 187/386 |
| 5,841,084 | A * | 11/1998 | Thangavelu | 187/382 |
| 6,129,182 | A * | 10/2000 | Nakamura | 187/391 |
| 6,672,431 | B2 * | 1/2004 | Brand et al. | 187/382 |
| 7,083,027 | B2 * | 8/2006 | Siikonen et al. | 187/383 |

FOREIGN PATENT DOCUMENTS

| | | |
|---|---|---|
| JP | 59 190171 | 10/1984 |
| JP | 59 190172 | 10/1984 |
| JP | 62 79171 | 4/1987 |
| JP | 64-013385 | 1/1989 |
| JP | 64-060583 | 3/1989 |
| JP | 6 271213 | 9/1994 |
| JP | 11 335010 | 12/1999 |
| JP | 2000 191247 | 7/2000 |

OTHER PUBLICATIONS

U.S. Appl. No. 13/260,111, filed Sep. 23, 2011, Tokura.
U.S. Appl. No. 12/595,523, filed Oct. 12, 2009, Tokura.
U.S. Appl. No. 13/057,197, filed Feb. 2, 2011, Tokura, et al.
Office Action (with English translation) issued on Jan. 31, 2012, in counterpart Japanese Appln. No. 2009-506108) (6 pages).

* cited by examiner

*Primary Examiner* — Anthony Salata
(74) *Attorney, Agent, or Firm* — Oblon, Spivak, McClelland, Maier & Neustadt, L.L.P.

(57) ABSTRACT

An elevator system including a car call registration device by which an elevator user registers a car call before riding on a car and a group supervisory controller with a building specification data storage section in which building specification data including specially-assigned floors is stored. Further, a specially-assigned floor judgment section judges whether a departure floor is a specially-assigned floor when a car call is registered, and a traffic condition judgment section judges the traffic condition of elevators within a building. A car assignment is performed based on the traffic condition judgment section judging by the specially-assigned floor judgment section that the departure floor is a specially-assigned floor, and a car assignment is performed based on a building specification stored in the building specification data storage section when the specially-assigned floor judgment section judges the departure floor is not a specially-assigned floor.

4 Claims, 3 Drawing Sheets

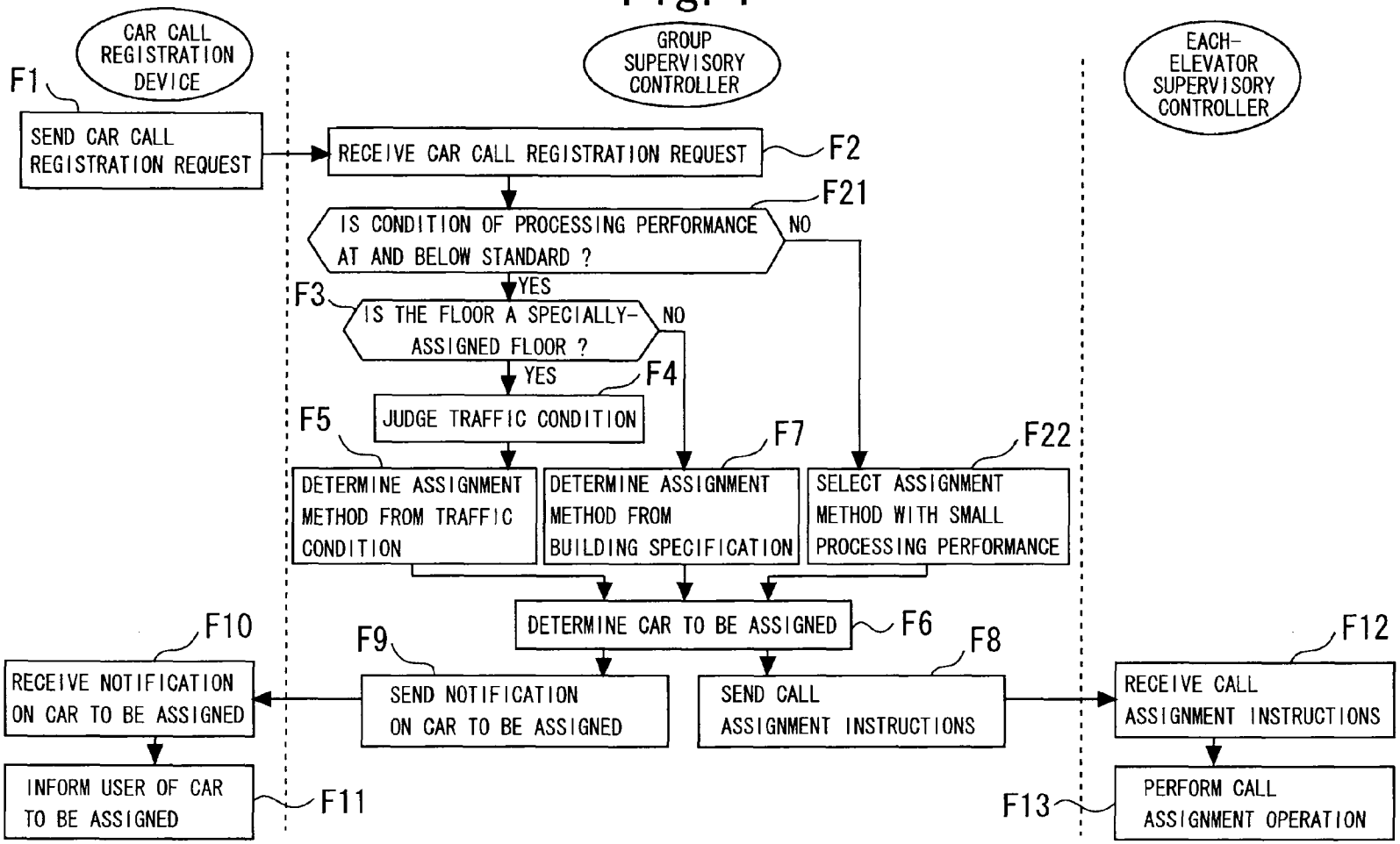
Fig. 4
CAR CALL REGISTRATION DEVICE
GROUP SUPERVISORY CONTROLLER
EACH-ELEVATOR SUPERVISORY CONTROLLER
F1
SEND CAR CALL REGISTRATION REQUEST
F2
RECEIVE CAR CALL REGISTRATION REQUEST
F21
IS CONDITION OF PROCESSING PERFORMANCE AT AND BELOW STANDARD ?
NO
YES
F3
IS THE FLOOR A SPECIALLY-ASSIGNED FLOOR ?
NO
YES
F4
JUDGE TRAFFIC CONDITION
F5
DETERMINE ASSIGNMENT METHOD FROM TRAFFIC CONDITION
F7
DETERMINE ASSIGNMENT METHOD FROM BUILDING SPECIFICATION
F22
SELECT ASSIGNMENT METHOD WITH SMALL PROCESSING PERFORMANCE
F6
DETERMINE CAR TO BE ASSIGNED
F8
SEND CALL ASSIGNMENT INSTRUCTIONS
F9
SEND NOTIFICATION ON CAR TO BE ASSIGNED
F10
RECEIVE NOTIFICATION ON CAR TO BE ASSIGNED
F11
INFORM USER OF CAR TO BE ASSIGNED
F12
RECEIVE CALL ASSIGNMENT INSTRUCTIONS
F13
PERFORM CALL ASSIGNMENT OPERATION

ELEVATOR SYSTEM

TECHNICAL FIELD

The present invention relates to an elevator system that operates a plurality of elevators with good efficiency.

BACKGROUND ART

In a building and the like where there are many elevator users, the group supervisory control of a plurality of elevators installed within one and the same building is performed, whereby the operation efficiency of an elevator system as a whole is improved. In the elevator system that performs such group supervisory control, in general, what is called elevators running neck to neck are eliminated by some method and each elevator is controlled so that the waiting time of users becomes short.

In a large-scale office building and the like, the number of elevator users tends to increase abruptly in specific time zones, such as the clock-in time zone, lunch time zone and clock-out time zone. For this reason, if the same group supervisory control is always performed in the above-described building and the like, the operation efficiency may decrease during peak busy hours.

Therefore, as a related art for solving the above-described problem, there has been proposed an elevator system that controls the operation of a plurality of elevators in which a car call registration device that enables a user to register a car call before riding on a car is provided in an elevator hall and operation control is performed according to the traffic condition in a building. In such an elevator system, operation modes are determined by judging the traffic condition in a building, and when a prescribed operation mode has been selected, floors to be serviced are zoned and set for each car according to the operation condition of each car (see Patent Document 1, for example).

Patent Document 1: Japanese Patent Laid-Open No. 2000-191247

DISCLOSURE OF THE INVENTION

Problems to be Solved by the Invention

In the elevator system described in Patent Document 1, when a prescribed operation mode has been selected, floors to be serviced are zoned and set for each car according to the operation condition of each car and, therefore, it is possible to improve the operation efficiency during peak busy hours. However, if car call registration is performed in a plurality of halls when a prescribed operation mode has been selected, much memory is necessary for processing, such as zoning and setting of floors to be serviced, which is performed for each car, and assignment of a car to each car call, and this has posed the problem that the processing load increases remarkably.

The present invention has been made to solve problems as described above and the object of the invention is to provide an elevator system capable of operating a plurality of elevators with good efficiency without an increase in the processing load for elevator control.

Means for Solving the Problems

An elevator system of the present invention is an elevator system that performs group supervisory control of a plurality of elevators, which comprises a car call registration device by use of which an elevator user registers a car call before riding on a car, a building specification data storage section in which building specification data including specially-assigned floors is stored, a specially-assigned floor judgment section that makes a judgment as to whether or not a departure floor is a specially-assigned floor when a car call has been registered by the car call registration device, a traffic condition judgment section that judges the traffic condition of elevators within a building, and an assignment control section that performs assignment of the car on the basis of judgment results of the traffic condition judgment section when it is judged by the specially-assigned floor judgment section that the departure floor is a specially-assigned floor, and performs assignment of the car on the basis of a building specification stored in the building specification data storage section when it is judged by the specially-assigned floor judgment section that the departure floor is not a specially-assigned floor.

Effect of the Invention

According to the present invention, it becomes possible to operate a plurality of elevators with good efficiency without an increase in the processing load for elevator control.

BRIEF OF DESCRIPTION OF THE DRAWINGS

FIG. 4 is a flowchart showing the operations of the elevator system in Embodiment 2 of the present invention.

DESCRIPTION OF SYMBOLS

1 car call registration device,
2 group supervisory controller,
3 assigned car information means,
4 building specification data storage section,
5 specially-assigned floor judgment section,
6 traffic condition judgment section,
7 assignment control section,
8 each-elevator supervisory controller,
9 car control means,
10 processing performance judgment section

BEST MODE FOR CARRYING OUT THE INVENTION

The present invention will be described in more detail in accordance with the accompanying drawings. Incidentally, in each of the drawings, like numerals refer to like or similar parts and overlaps of description of these parts are appropriately simplified or omitted.

Embodiment 1

Figure 1:
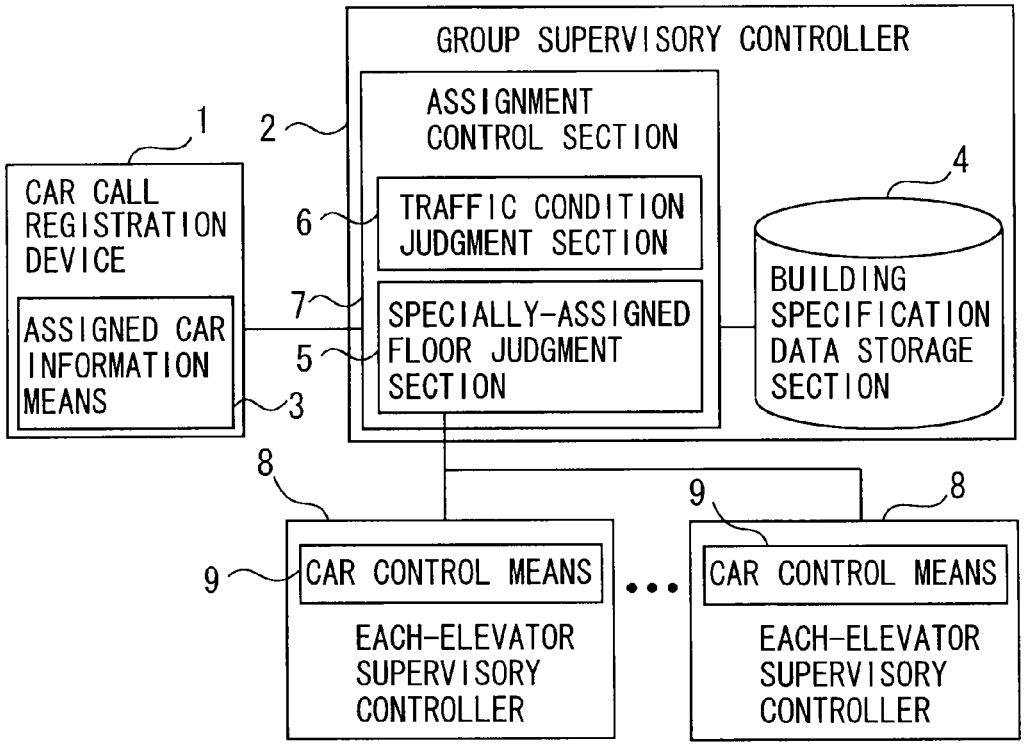
FIG. 1 is a block diagram showing an elevator system in Embodiment 1 of the present invention.
Figure 2:
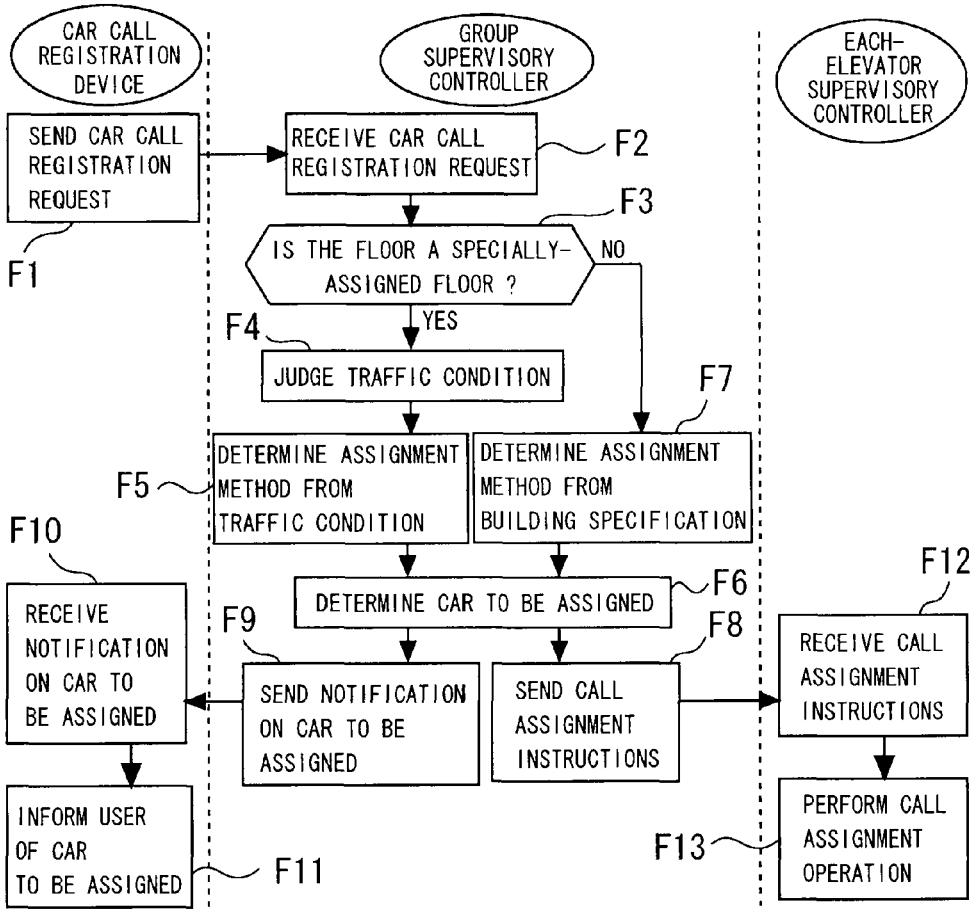
FIG. 2 is a flowchart showing operations of the elevator system in Embodiment 1 of the present invention.

FIG. 1 is a block diagram showing an elevator system in Embodiment 1 of the present invention, and FIG. 2 is a flowchart showing operations of the elevator system in Embodiment 1 of the present invention. Incidentally, the configuration and operations of the elevator system shown in FIGS. 1 and 2 are intended for the group supervisory control of a plurality of elevators installed within one and the same building. First, the configuration of the above-described elevator system will be described on the basis of FIG. 1.

In FIG. 1, reference numeral 1 denotes a car call registration device by use of which an elevator user registers a car call (a destination floor) before riding on a car. When a destination floor is inputted by the operation of a user, this car call registration device 1 outputs a car call registration request to a group supervisory controller 2, which will be described later. The car call registration device 1 is provided with assigned car information means 3 that informs users in an elevator hall of an assigned car for the car call registration request.

The above-described car call registration device 1 is provided in an elevator hall, and is equipped, for example, with input buttons by use of which users input destination floors and a display or a speaker for informing users of assigned cars. This car call registration device 1 may be available on all floors within the building or may also be available only on specific floors, such as a main floor (a lobby floor and the like), a VIP floor, a cafeteria floor and a floor where there is a conference room. The car call registration device 1 may be available only on a specific hall.

Incidentally, the car call registration device 1 may be a mobile terminal carried by a user, which permits wireless communication with the group supervisory controller 2. Examples of the above-described mobile terminal include a PHS (personal handyphone system), a PDA (personal digital assistance) and a notebook PC. In such a case, it is possible to adopt a method by which a receiver capable of receiving signals from the above-described mobile terminal is installed near a hall and short-distance wireless communication is performed, or telephone or Internet communication is performed by use of a public line.

The above-described car call registration device 1 may be a device which has a personal ID collation function and personal ID data, automatically distinguishes a destination floor by referring to the personal ID data when a user collates a personal ID, and outputs a car call registration request corresponding to the distinguished destination floor. The collation of the personal ID by the user is performed with the aid of, for example, a key, a card, an IC tag and the like in which a personal ID is recorded, and with the aid of biological information, such as a fingerprint, a vein, a voice print and an iris.

The group supervisory controller 2 is intended for the group supervisory control of a plurality of elevators installed within one and the same building. This group supervisory controller 2 is provided with, for example, a building specification data storage section 4, a specially-assigned floor judgment section 5, a traffic condition judgment section 6, and an assignment control section 7.

The above-described building specification data storage section 4 is means for storing specification data specific to the building, such as the number of floors, congested floors, congestion hours and the like of the building. Also information on specially-assigned floors is stored in the building specification data storage section 4. Incidentally, if a floor on which a user has inputted a destination floor (hereinafter referred to as a "departure floor") is set as the above-described specially-assigned floor when a destination floor is inputted by the above-described car call registration device 1, the assignment control section 7 performs control different from the control performed in a case where the departure floor has not been set as a specially-assigned floor. That is, the above-described specially-assigned floor means a floor that is set beforehand in order to perform car assignment by a special method in response to a car call registration request, and this specially-assigned floor corresponds to only part of the floors at which the car stops. For example, specially-assigned floors are set beforehand for a main floor that provides an entrance of the building and a floor that is used mainly by important people and VIPs, such as the president and the owner of the building. Furthermore, it is also possible to adopt a configuration in which floors on which there are a cafeteria, conference rooms and the like, which become crowded only during specific times, are set as specially-assigned floors only during the specific time zones in line with a schedule stored beforehand in the building specification.

The specially-assigned floor judgment section 5 is means for judging as to whether or not the departure floor is a specially-assigned floor on the basis of the information stored in the building specification data storage section 4 when a car call registration request is inputted to the group supervisory controller 2.

The traffic condition judgment section 6 is means for judging the pattern of the traffic condition of the elevator occurring within the building by measuring the traffic condition. When it is judged by the specially-assigned floor judgment section 5 that the departure floor is a specially-assigned floor, this traffic condition judgment section 6 carries out the above-described pattern judgment. Incidentally, the judgment method of the traffic condition judgment section 6 is not especially limited to one method, but there have hitherto been reported a method that uses the total number of persons who ride on a car and the degree of congestion on a main floor, a method by which a pattern judgment is made by use of neural net techniques, and the like.

The assignment control section 7 is means for assigning a car to an inputted car call registration request on the basis of the judgment results of the specially-assigned floor judgment section 5 and the traffic condition judgment section 6 when the car call registration request has been inputted to the group supervisory controller 2. Specifically, the assignment control section 7 performs the assignment of a car to a car call registration request on the basis of the traffic condition judged by the traffic condition judgment section 6 when it is judged by the specially-assigned floor judgment section 5 that the departure floor is a specially-assigned floor. The assignment method at this time may be, for example, a method in which importance is attached to the shortening of the running time of a car by limiting the number of stops per car by a value determined from the traffic condition or a method in which importance is attached to the prevention of a situation which is such that no one can ride on a car, which is fully loaded, at a specially-assigned floor, by storing the number of people who ride on a car and the number of people who get out of a car at each floor for each car. Also, an assignment method in which these methods are combined and other assignment methods may be adopted.

On the other hand, when it is judged by the specially-assigned floor judgment section 5 that the departure floor is not a specially-assigned floor, the assignment control section 7 performs the assignment of a car to a car call registration request on the basis of the building specification stored in the building specification data storage section 4. This assignment method at this time may be, for example, a method of determining the car to be assigned by an evaluation method similar to the evaluation method that is carried out when a call is registered by use of a general UP/DN button to a car serviceable to both of the departure floor and the destination floor or a method in which importance is attached to the shortening of the running time of a car by limiting the number of stops per car by a value determined from the building specification. Also, an assignment method in which these methods are combined and other assignment methods may be adopted.

After the determination of the assignment of a car to an inputted car call registration request, the assignment control section 7 sends call assignment instructions to an each-elevator supervisory controller 8 and sends information on an assigned car to the car call registration device 1.

The each-elevator supervisory controller 8 is intended for the supervisory control of each elevator. The each-elevator supervisory controllers 8 are each provided with car control means 9 for actually performing the operation control of cars of each elevator. The each-elevator supervisory controller 8 controls the operation of a car through the use of the car control means 9 on the basis of call assignment instructions inputted from the assignment control section 7 of the group supervisory controller 2.

Incidentally, the above-described car call registration device 1, group supervisory controller 2 and each-elevator supervisory controller 8 are each connected by a network and configured to perform mutual information communication.

Next, a description will be given of specific operations of the elevator system having the above-described configuration on the basis of FIG. 2. When an elevator user registers his or her destination floor by depressing a destination floor button of the car call registration device 1 in a hall of a given floor, a car call registration request is sent from the car call registration device 1 to the group supervisory controller 2 (F1). Upon receiving the car call registration request (F2), the group supervisory controller 2, first, makes a judgment as to whether or not the floor on which the user who has inputted the car call is present has been set as a specially-assigned floor (F3) by the specially-assigned floor judgment section 5. Specifically, on the basis of the inputted car call registration request and the information on building specification stored in the building specification data storage section 4, the specially-assigned floor judgment section 5 makes a judgment as to whether or not the departure floor has been set as a specially-assigned floor.

When it is judged by the specially-assigned floor judgment section 5 that the departure floor has been set as a specially-assigned floor, next, the traffic condition of the elevator within the building is judged by the traffic condition judgment section 6 (F4). And the assignment control section 7 sets a car assignment method on the basis of the judgment results of the traffic condition judgment section 6 (F5), and determines a specific car to be assigned by this assignment method (F6). On the other hand, when it is judged by the specially-assigned floor judgment section 5 that the departure floor has not been set as a specially-assigned floor, the assignment control section 7 sets a car assignment method on the basis of the building specification stored in the building specification data storage section 4 (F7) and determines a specific car to be assigned by this assignment method (F6).

After the determination of a car to be assigned to the car call registration request, the assignment control section 7 sends call assignment instructions to the each-elevator supervisory controller 8 (F8) and informs the car call registration device 1 of the car to be assigned (F9). Upon receiving the information of the car to be assigned (F10), the car call registration device 1 informs the user present in the hall of an assigned car by the assigned car information means 3 (F11). On the other hand, upon receiving the call assignment instruction from the group supervisory controller 2 (F12), the each-elevator supervisory controller 8 performs call assignment operation by use of the car control means 9 (F13) and causes the user to move to the desired destination floor.

According to Embodiment 1 of the present invention, it becomes possible to operate a plurality of elevators with good efficiency without an increase in the processing load for elevator control. That is, when the floor that has been set as a specially-assigned floor becomes the departure floor, car assignment is determined on the basis of the traffic condition of an elevator within the building and, therefore, it is possible to shorten the waiting time of users even on a main floor and the like where the access of people are frequent and it becomes possible to improve the operation efficiency. On the other hand, when the departure floor has not been set as a specially-assigned floor, car assignment is determined simply on the basis of the building specification. Therefore, it is possible to prevent a situation which is such that the processing load of the group supervisory controller 2 increases remarkably, for example, even in a case where the registration of destination floors has been carried out in halls of a plurality of floors.

Accordingly, by performing assignment control of destination floor registration for each floor, such as assignment which is such that in accordance with the building specification, the number of destination floors is limited for specific floors, such as a main floor, and the number of destination floors is not considered for floors other than the specific floors, it becomes possible to increase the number of floors for which destination floor registration is carried out without an increase in the processing load.

Embodiment 2

Figure 3:
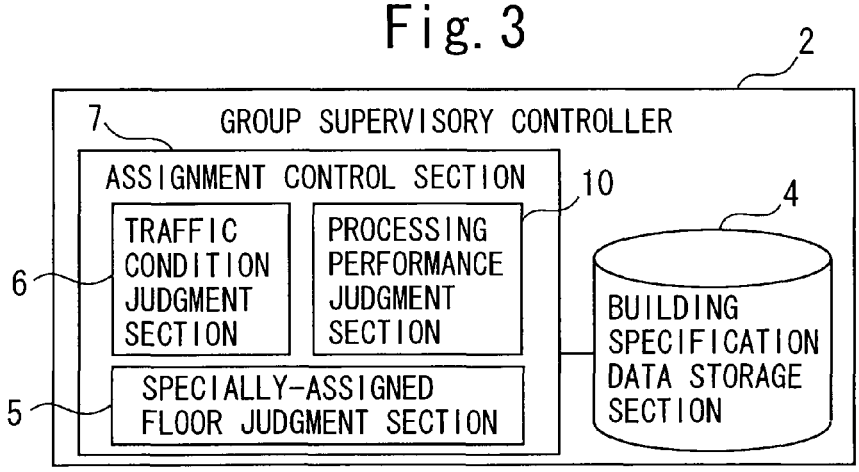
FIG. 3 is a block diagram showing the main part of an elevator system in Embodiment 2 of the present invention.

FIG. 3 is a block diagram showing the main part of an elevator system in Embodiment 2 of the present invention, and FIG. 4 is a flowchart showing the operations of the elevator system in Embodiment 2 of the present invention. In FIG. 3, a group supervisory controller 2 is provided with a processing performance judgment section 10 in addition to a building specification data storage section 4, a specially-assigned floor judgment section 5, a traffic condition judgment section 6, and an assignment control section 7. Other points of configuration are the same as in Embodiment 1.

The processing performance judgment section 10 is means for judging the condition of the processing performance of the group supervisory controller 2 having the assignment control section 7. Specifically, the above-described processing performance judgment section 10 makes a judgment as to whether or not the condition of the processing performance of the group supervisory controller 2 during judgment exceeds a prescribed standard condition. The condition of the processing performance is determined by, for example, the used amount of a memory, the usage rate of a CPU and the like. Incidentally, the above-described condition of the processing performance may be determined by the number of calls or the number of each-elevator supervisory controllers 8 controlled by the group supervisory controller 2 during the judgment or may be determined by the number of floors for which a car assignment method based on the traffic condition is carried out or the number of floors for which a car assignment method based on the building specification is carried out. Furthermore, these methods may be combined.

When a car call registration request has been inputted to the group supervisory controller 2, the assignment control section 7 performs car assignment to the inputted car call registration request on the basis of the judgment results of the specially-assigned floor judgment section 5 and the traffic condition judgment section 6 and the judgment results of the processing performance judgment section 10. Specifically, when it is judged by the processing performance judgment section 10 that the condition of the processing performance is at the level of and below a standard condition, the assignment control section 7 judges that the processing performance has a margin to some extent, and performs car assignment based on the judgment on specially-assigned floors and the judgment on the traffic condition in the same manner as in Embodiment 1.

On the other hand, when it is judged by the processing performance judgment section 10 that the condition of the processing performance exceeds a standard condition, the assignment control section 7 performs car assignment to a car call registration request by a method that requires a smaller processing load than in the above-described assignment method that is carried out in the case where the condition of the processing performance does not exceed a standard condition. The assignment method at this time may be, for example, a method by which a car to be assigned is determined by the same evaluation method as adopted when a call has been registered by use of a general UP/DN button, or may be a method in which importance is attached to the shortening of the running time of a car by limiting the number of stops per car by a fixed value. Also, an assignment method in which these methods are combined and other assignment methods may be adopted.

Next, a description will be given of specific operations of the elevator system having the above-described configuration on the basis of FIG. 4. Incidentally, the operations of F1 to F13 in FIG. 4 are the same as in FIG. 2 and, therefore, specific descriptions thereof are omitted.

Upon receiving a car call registration request (F2), the group supervisory controller 2, first, judges the condition of the processing performance of the group supervisory controller 2 at that point in time by use of the processing performance judgment section 10 (F21). Specifically, the processing performance judgment section 10 makes a judgment as to whether or not the condition of the processing performance of the group supervisory controller 2 at the time of receipt of the car call registration request exceeds a prescribed standard condition. When it is judged by the processing performance judgment section 10 that the condition of the processing performance of the group supervisory controller 2 exceeds a standard condition, the assignment control section 7 selects an assignment method with processing performance smaller than in a car assignment method carried out in F3 and under (F22), and determines a specific car to be assigned by this assignment method (F6). On the other hand, when it is judged by the processing performance judgment section 10 that the condition of the processing performance of the group supervisory controller 2 is at the level of and below a standard condition, the processing proceeds to F3, where a judgment on specially-assigned floors is carried out. Incidentally, the later operations are the same as in Embodiment 1.

According to Embodiment 2 of the present invention, upon receipt of a car call registration request by the group supervisory controller 2, an assignment method suited to the condition of the processing performance of the group supervisory controller 2 is selected on the basis of the judgment results of the processing performance judgment section 10. Accordingly, for example, even in a case where the registration of destination floors has been carried out in halls of a plurality of floors, it is possible to constantly maintain the processing performance of the group supervisory controller 2 at the level of and below a prescribed condition and to prevent a remarkable increase in the processing load. In other respects, effects similar to those of Embodiment 1 can be produced.

INDUSTRIAL APPLICABILITY

As described above, according to the elevator system related to the present invention, it is possible to operate a plurality of elevators with good efficiency without an increase in the processing load for elevator control. Therefore, the elevator system related to the present invention can be applied to an elevator system in general for which destination floor registration is performed before users ride on cars.

The invention claimed is:

1. An elevator system that performs group supervisory control of a plurality of elevators, comprising:

a car call registration device by use of which an elevator user registers a car call before riding on a car;

a building specification data storage section in which building specification data including specially-assigned floors is stored;

a specially-assigned floor judgment section that makes a judgment as to whether or not a departure floor is a specially-assigned floor when a car call has been registered by the car call registration device;

a traffic condition judgment section that judges the traffic condition of elevators within a building; and an assignment control section that performs assignment of the car on the basis of judgment results of the traffic condition judgment section when it is judged by the specially-assigned floor judgment section that the departure floor is a specially-assigned floor, and performs assignment of the car on the basis of a building specification stored in the building specification data storage section when it is judged by the specially-assigned floor judgment section that the departure floor is not a specially-assigned floor.

2. The elevator system according to claim 1, wherein the assignment control section performs assignment of the car so that the number of stops of a car of each elevator becomes not more than a limited value set on the basis of a traffic condition when it is judged by the specially-assigned floor judgment section that the departure floor is a specially-assigned floor, and performs assignment of the car so that the number of stops of the car of each elevator becomes not more than a limited value set on the basis of a building specification when it is judged by the specially-assigned floor judgment section that the departure floor is not a specially-assigned floor.

3. The elevator system according to claim 1, wherein the elevator system further comprises a processing performance judgment section that judges the condition of the processing performance of the group supervisory controller having the assignment control section, and in that the assignment control section performs assignment of a car on the basis of judgment results of the specially-assigned floor judgment section and the traffic condition judgment section when it is judged by the processing performance judgment section that the condition of the processing performance does not exceed a prescribed standard condition, and performs assignment of the car by a method with a smaller processing load than that of an assignment method that is carried out in the case where the condition of the processing performance does not exceed the standard condition when it is judged by the processing performance judgment section that the condition of the processing performance exceeds the standard condition.

4. The elevator system according to claim 2, wherein the elevator system further comprises a processing performance judgment section that judges the condition of the processing performance of the group supervisory controller having the assignment control section, and in that the assignment control section performs assignment of a car on the basis of judgment results of the specially-assigned floor judgment section and the traffic condition judgment section when it is judged by the processing performance judgment section that the condition of the processing performance does not exceed a prescribed standard condition, and performs assignment of the car by a method with a smaller processing load than that of an assignment method that is carried out in the case where the condition of the processing performance does not exceed the standard condition when it is judged by the processing performance judgment section that the condition of the processing performance exceeds the standard condition.

* * * * *